US006641019B2

(12) United States Patent
Hadfield

(10) Patent No.: US 6,641,019 B2
(45) Date of Patent: Nov. 4, 2003

(54) FASTENER DRIVING TOOL WITH MULTI-SIZE FASTENER MAGAZINE

(76) Inventor: Robert Hadfield, R.R. 1, Box 68, Lowpoint, IL (US) 61545

( * ) Notice: Subject to any disclaimer, the term of this patent is extended or adjusted under 35 U.S.C. 154(b) by 0 days.

(21) Appl. No.: 09/907,145

(22) Filed: Jul. 16, 2001

(65) Prior Publication Data

US 2002/0050506 A1 May 2, 2002

Related U.S. Application Data

(60) Provisional application No. 60/222,092, filed on Jul. 28, 2000.

(51) Int. Cl.[7] ..... B25C 5/16
(52) U.S. Cl. ..... 227/109; 227/120; 227/136
(58) Field of Search ..... 227/109, 120, 227/136

(56) References Cited

U.S. PATENT DOCUMENTS 4,585,154 A * 4/1986 Fealey et al. ..... 227/109
4,784,306 A * 11/1988 Baum ..... 227/113
4,801,062 A * 1/1989 Austin ..... 227/128
5,370,295 A 12/1994 Simonelli
5,522,533 A 6/1996 Mukoyama et al.
5,626,274 A * 5/1997 Shkolnikov et al. ..... 227/109
5,639,007 A * 6/1997 Nakamura ..... 227/109
5,683,024 A * 11/1997 Eminger et al. ..... 227/8
5,697,541 A * 12/1997 Burke et al. ..... 227/109
5,813,588 A 9/1998 Lin
5,842,625 A 12/1998 Kimura
5,897,046 A 4/1999 Oehri et al.
5,975,399 A 11/1999 Oehri et al.

* cited by examiner

*Primary Examiner*—Stephen F. Gerrity
*Assistant Examiner*—Gloria R Weeks
(74) *Attorney, Agent, or Firm*—H. Frederick Rusche, Esq.; Robert Muir, Esq.; Husch & Eppenberger, LLC

(57) ABSTRACT

A fastener driving tool includes a magazine comprised of a plurality of fastener slides, each of which carries a fasteners of a different size. The magazine is designed so that an operator may to choose to drive fasteners from any of the fastener slides. In one embodiment, the fastener slides are arranged around a central core. A rod supported by the tool's base and driver fits within the central core and provides an axis of rotation for the magazine. During rotation of the magazine, each slide can be aligned with the driver. Alignment of a slide is maintained by a position locking means. A feed means in each slide forces the fasteners down the slide and into the driver. In another embodiment, the fastener slides are arranged next to one another in the magazine. Each slide can be aligned with the driver by shifting the magazine laterally. A position locking means keeps the magazine in the proper alignment once a particular fastener slide has been chosen. A feed means forces the fasteners down the slide and into the driver.

12 Claims, 9 Drawing Sheets

FASTENER DRIVING TOOL WITH MULTI-SIZE FASTENER MAGAZINE

CROSS REFERENCES

This application claims the priority of provisional application Serial No. 60/222,092, filed Jul. 28, 2000.

TECHNICAL FIELD

This invention relates generally to fastener driving tools and, more particularly, to a fastener driving tool with a magazine attachment that allows a single fastener driving tool to carry and drive fasteners from a plurality of fastener slides, each containing fasteners of a different size.

BACKGROUND OF THE INVENTION

The prior art bears a variety of references disclosing improvements in the feeding mechanism for nail or fastener driving tools. Most of the devices disclosed in these references are directed toward improvements in the magazine, which holds a supply of nails or fasteners, to aid in the efficiency of feeding the fasteners to the driving mechanism of the tool.

U.S. Pat. Nos. 5,842,625; 5,897,046; and 5,975,399 are directed to magazine assemblies that have means for constantly urging nails or fasteners along a guide toward the driving mechanism. U.S. Pat. No. 5,842,625 discloses a nail guide plate and a nail cover which combine to form a guide groove which guides nails from a nail magazine to the nose where the driving mechanism is located. U.S. Pat. Nos. 5,897,046 and 5,975,399 describe a fastener driving apparatus which includes a magazine and a transport slide that allows fastening elements held by a carrying strip to be used and which moves the carrying strip opposite to the transporting direction in the magazine without the expenditure of force. The devices disclosed in these references are limited to using a single size fastener at any one time.

U.S. Pat. Nos. 5,522,533 and 5,813,588 relate to magazine assemblies for fastener driving tools that are adaptable for dispensing different size or quantities of fasteners. U.S. Pat. No. 5,522,533 discloses a magazine with a slide door forming a fastener storing chamber which is capable of holding fasteners of varying sizes. A pusher urges a strip of fasteners toward the driving mechanism. A directing member ensures that the fasteners are flush against the bottom surface of the fastener storing chamber. U.S. Pat. No. 5,813,588 describes a magazine assembly with a track element with a plurality of slide grooves to accommodate differing lengths of fasteners. A longitudinal track element and a guide plate combine to secure fasteners into the track element. While the above devices are capable of holding and driving fasteners of different sizes, only one size fastener can be used at one time. If a different sized nail or fastener is required, the remaining fasteners must be removed from the magazine so that the desired fasteners may be loaded.

The present invention is directed to overcoming one or more of the problems set forth above.

SUMMARY OF THE INVENTION

An aspect of the present invention is to provide a device that allows a fastener driving tool to carry a plurality of different sized fasteners at the same time.

Another aspect of the present invention is to provide a device that allows an operator of a fastener driving tool to choose among a plurality of different sized fasteners, each being immediately available to the operator without requiring that the other fasteners be removed from the tool.

In accordance with the above aspects of the invention, there is provided a fastener driving tool attachment with a magazine composed of a plurality of fastener slides. In one embodiment, the fastener slides are arranged around a central core. A rod attached to a handle on the tool and leading to a driver in the tool fits within the central core. The central core fits slidably around the rod, forming a center of rotation for the magazine. When attached with the rod, one end of the magazine abuts the driver. During rotation of the magazine, each fastener slide can be aligned with the driver. The magazine is temporarily held in a position in which one of the fastener slides is aligned with the driver by a position locking means. While the fastener slide is held in alignment with the driver, a feed means forces the fasteners in the slide toward and into the driver. If the operator desires to use a different size nail, he or she simply rotates the magazine until the fastener slide containing the desired size of fastener is aligned with the driver.

In another embodiment, the fastener slides are arranged in a parallel relationship to one another. The slides are a fixed part of a magazine which is attached to the fastener driving tool. The magazine may be shifted in a lateral direction perpendicular to the direction of the slides. A position locking means positions the magazine to allow alignment of each fastener slide with the driver. A feed means forces fasteners down the slide and into the driver. If the operator desires to use a different size fastener, he or she simply releases the position locking means to allow shifting of the magazine. When the fastener slide containing the desired fasteners is aligned with the driver, the operator engages the position locking means.

These aspects are merely illustrative aspects of the innumerable aspects associated with the present invention and should not be deemed as limiting in any manner. These and other aspects, features and advantages of the present invention will become apparent from the following detailed description when taken in conjunction with the referenced drawings.

DESCRIPTION OF THE DRAWINGS

Reference is now made to the drawings which illustrate the best known mode of carrying out the invention and wherein the same reference numerals indicate the same or similar parts throughout the several views.

DESCRIPTION OF THE PREFERRED EMBODIMENTS

Figure 1:
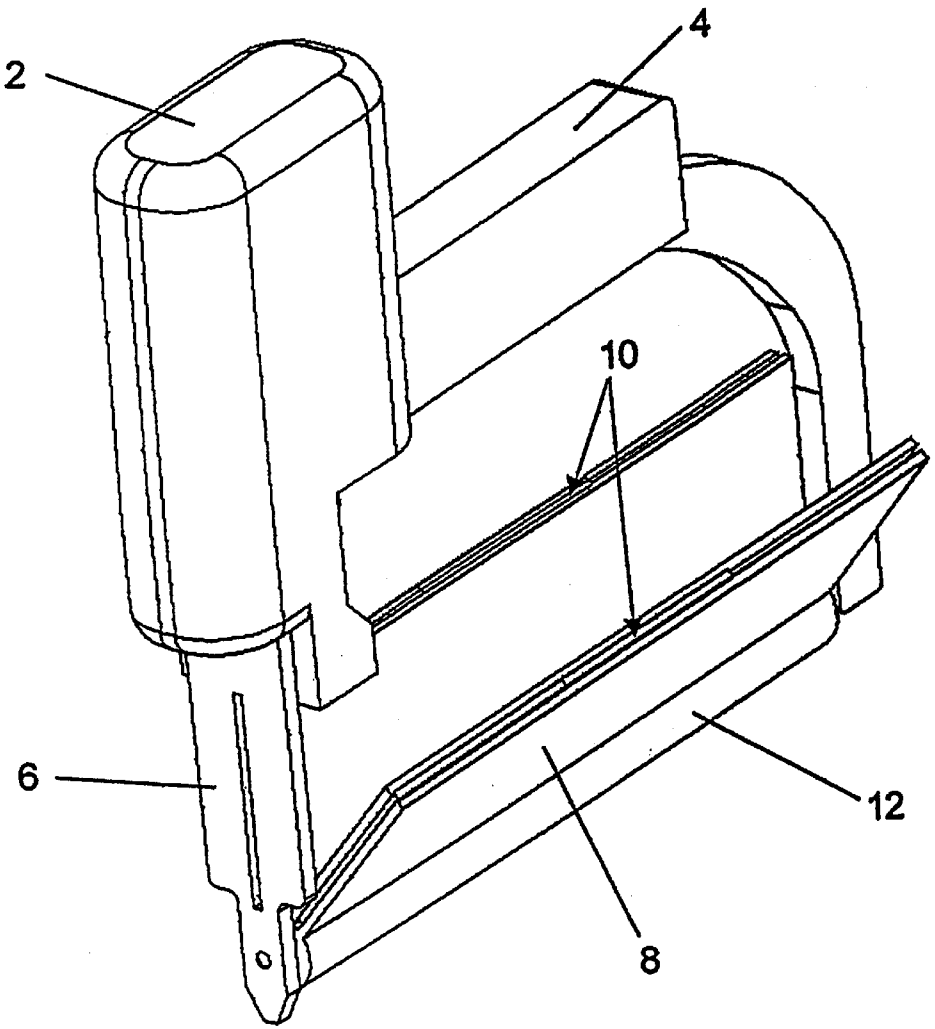
FIG. 1 is a perspective view of a fastener driving tool using one embodiment of a magazine according to the present invention.
Figure 2:
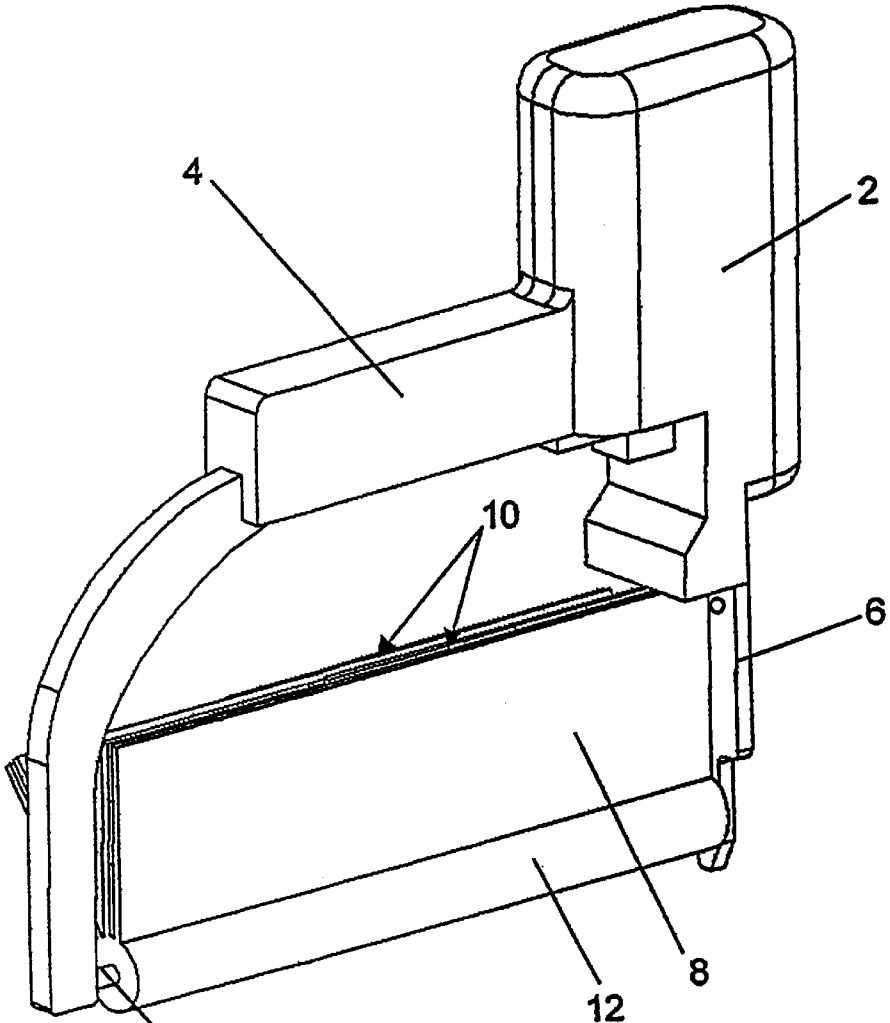
FIG. 2 is a perspective view of the fastener driving tool of FIG. 1 taken from the opposite direction.
Figure 3:
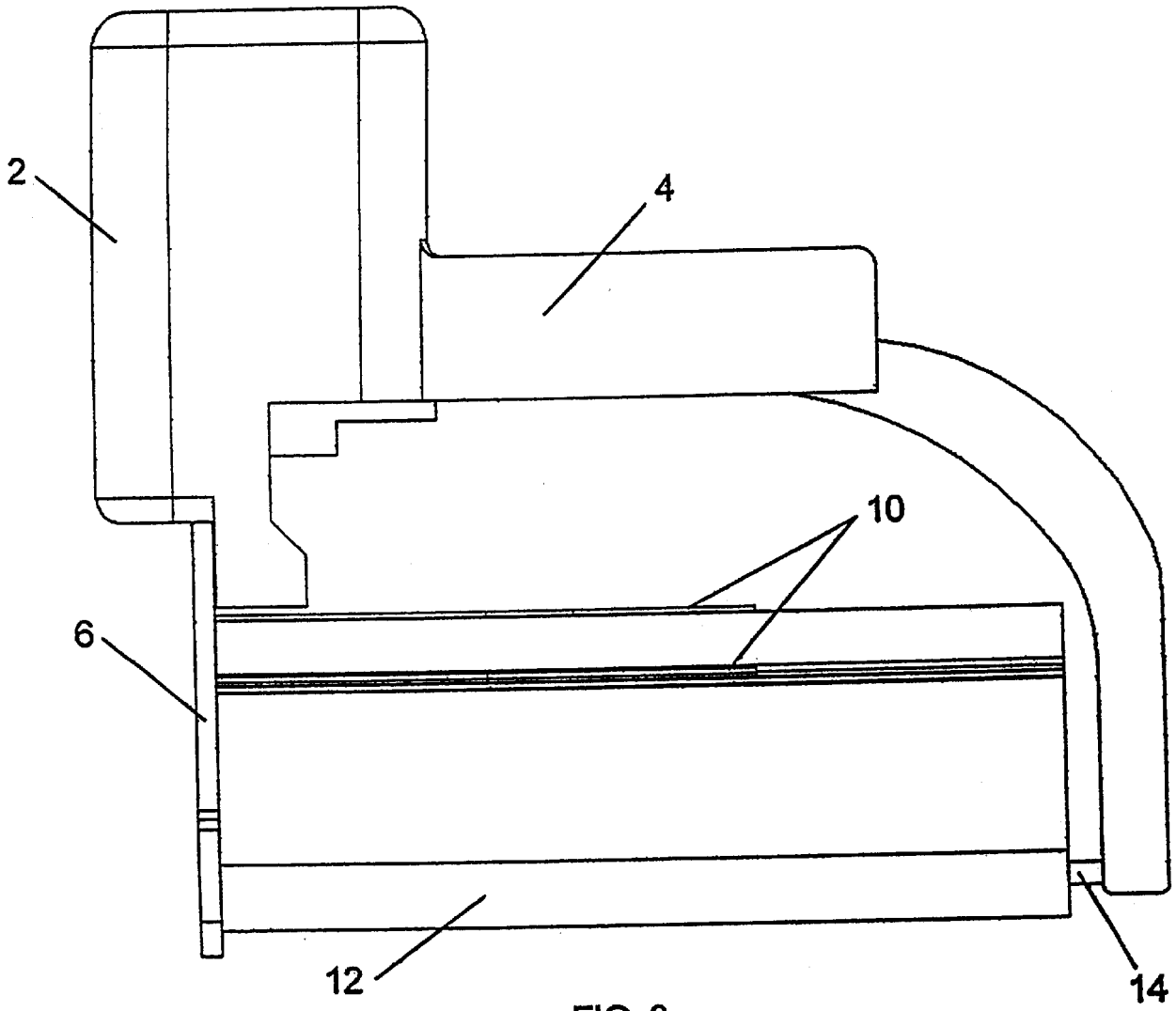
FIG. 3 is a front view of the fastener driving tool of FIG. 1.
Figure 4:
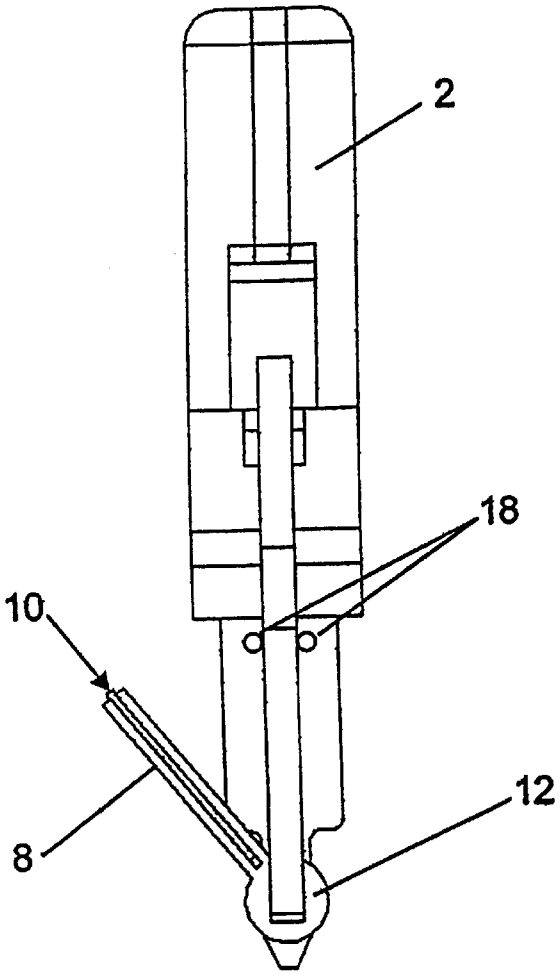
FIG. 4 is a side view of the fastener driving tool of FIG. 1.
Figure 5:
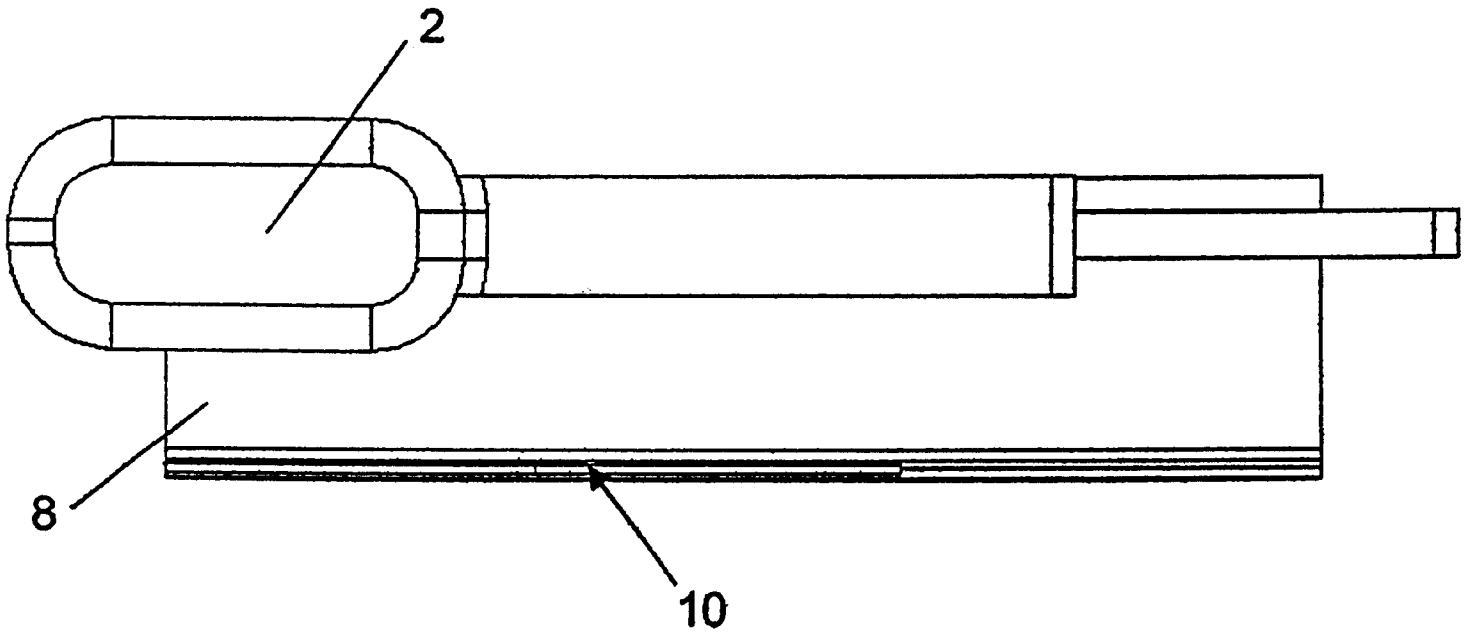
FIG. 5 is a top view of the fastener driving tool of FIG. 1.
Figure 6:
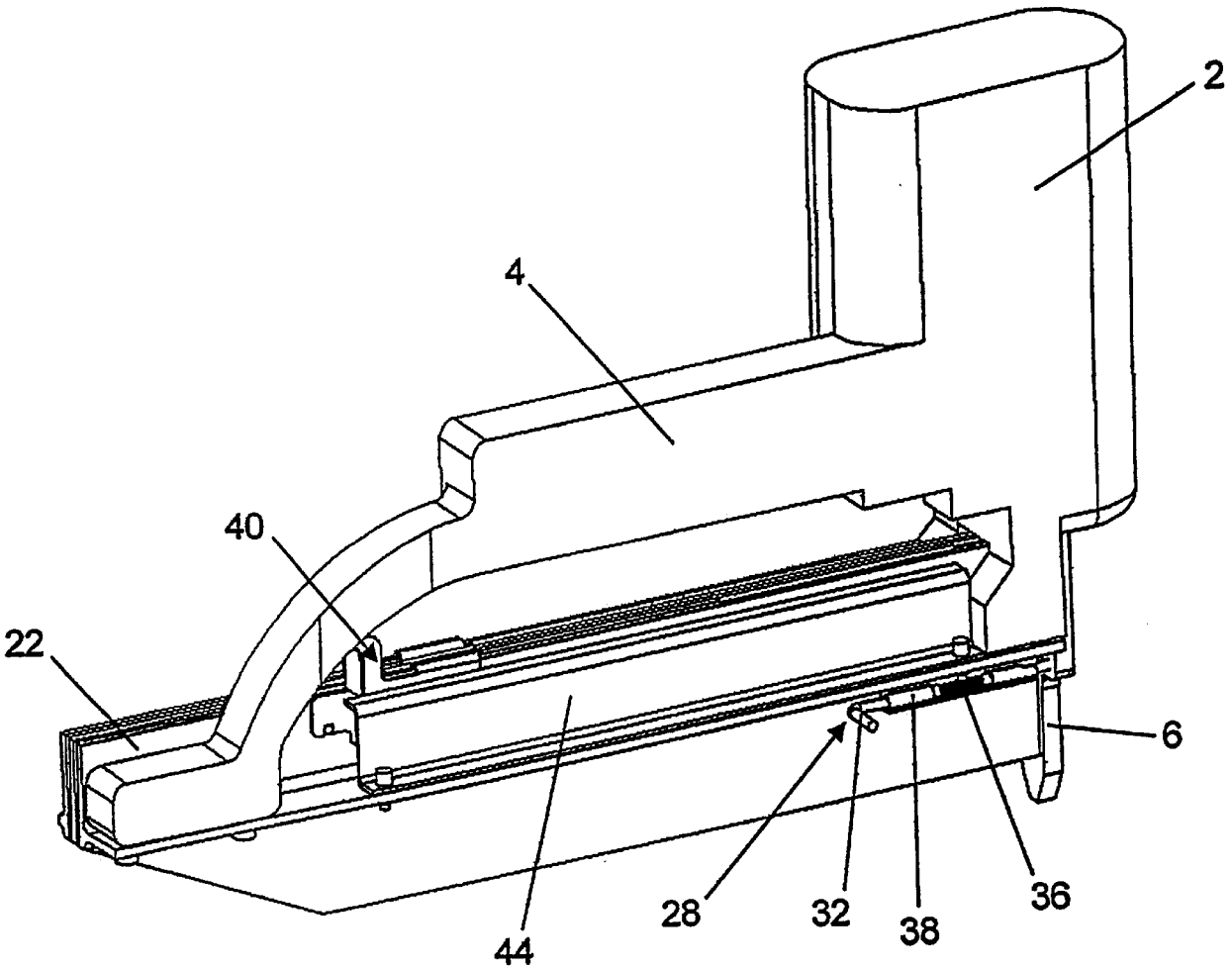
FIG. 6 is a perspective view of a fastener driving tool using another embodiment of a magazine according to the present invention.
Figure 7:
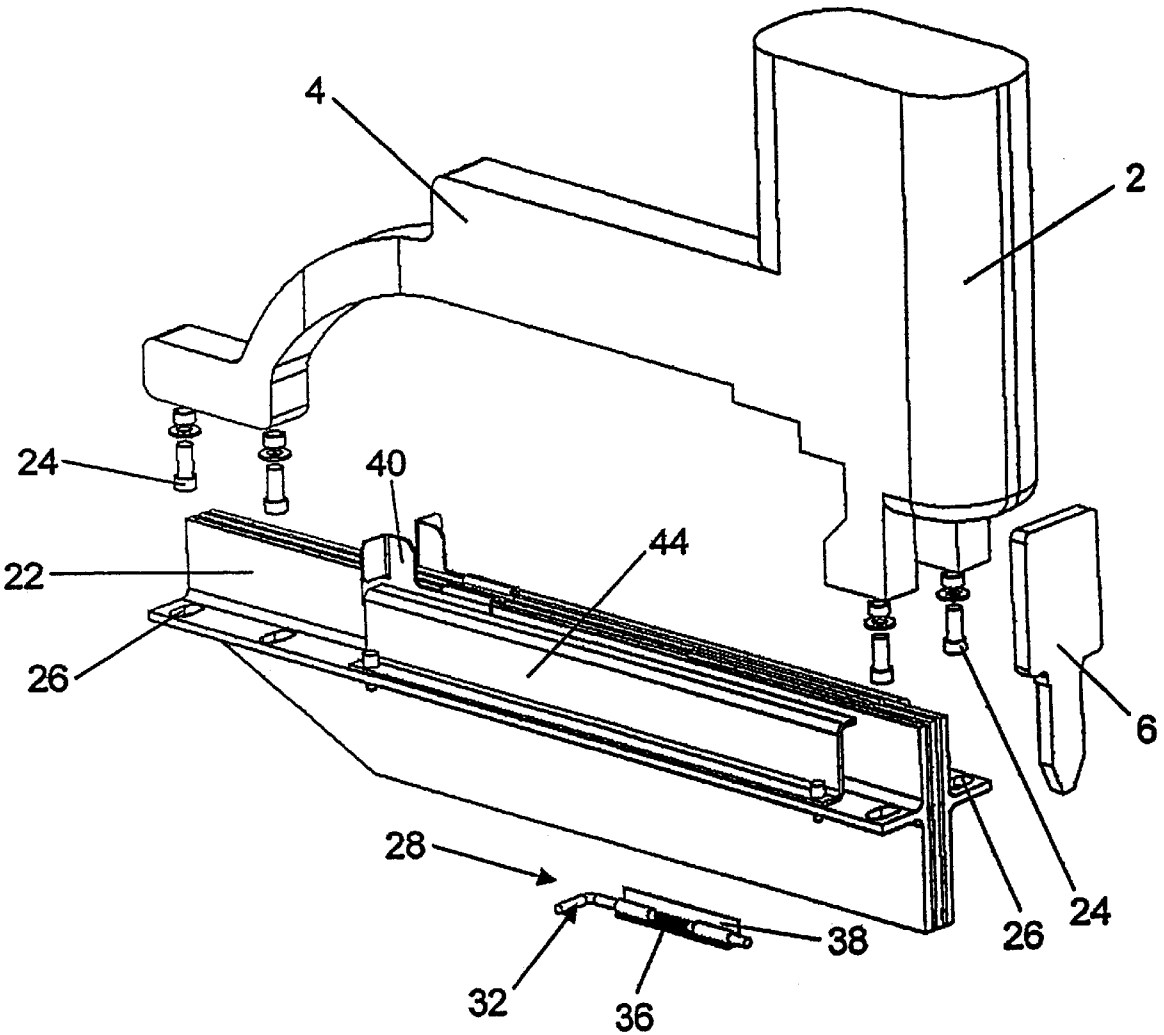
FIG. 7 is an exploded assembly view of the fastener driving tool of FIG. 6.
Figure 8:
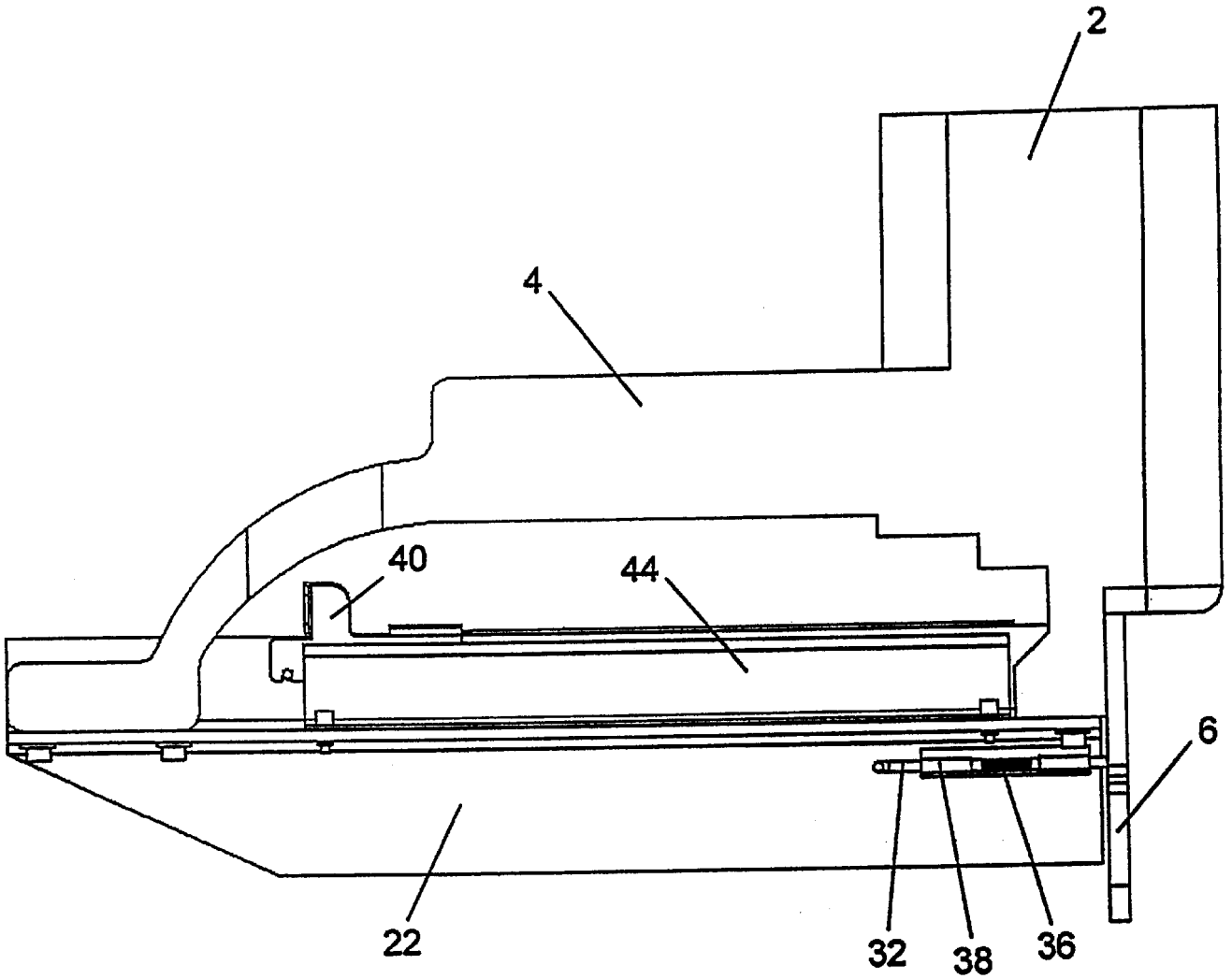
FIG. 8 is a side view of the fastener driving tool of FIG. 6.
Figure 9:
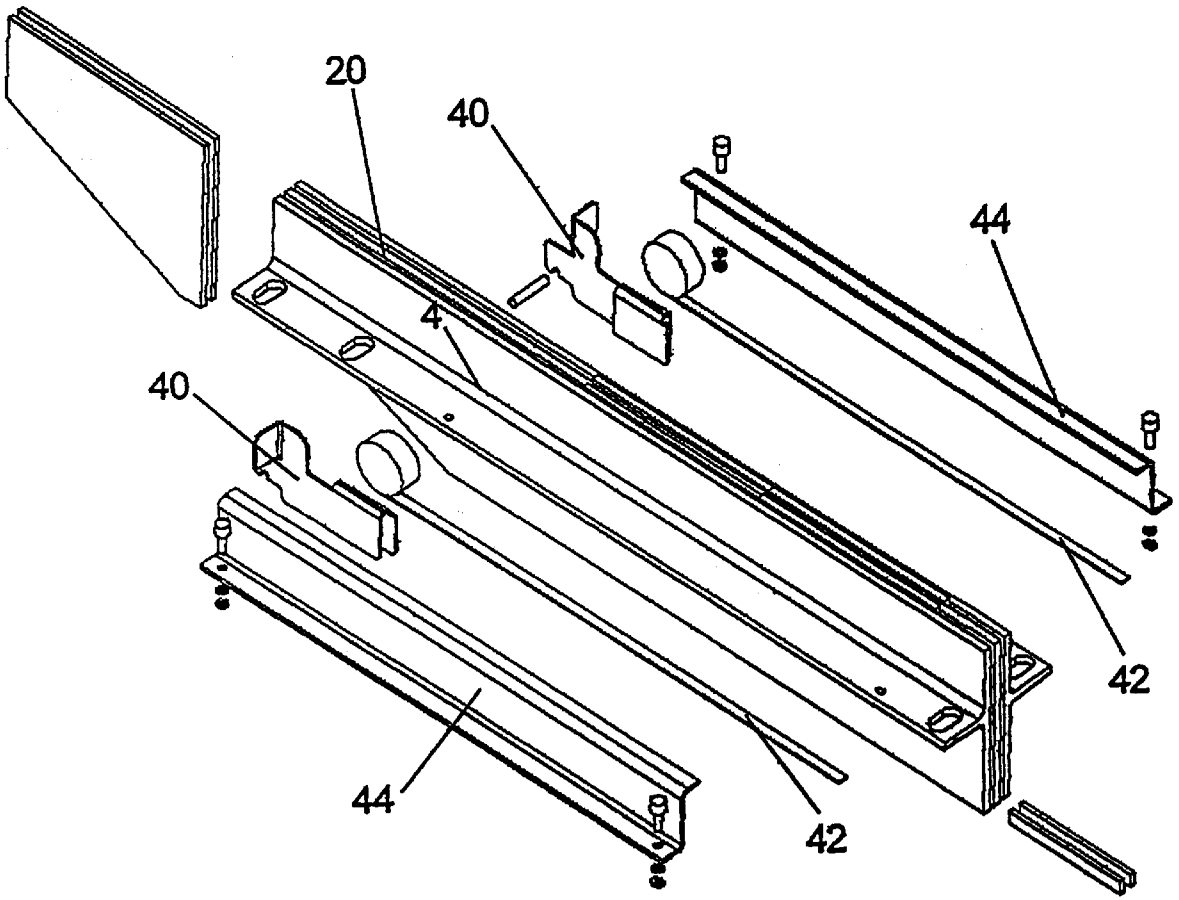
FIG. 9 is an isolated exploded assembly view of a magazine according to the present invention.

As shown in FIGS. 1–9, the general design of most fastener driving tools includes a base 2, which contains a power source; a handle 4 which an operator uses to control the tool; a driver 6, which transfers force derived from the power source to fasteners; a magazine which contains a supply of fasteners and delivers them to the driver; and a trigger (not shown), which initiates the driver. Pneumatically powered tools also have an air inlet nozzle (not shown) for a source of pressurized air.

The present invention replaces the standard magazine, which is limited to the use of one size of fastener at a time, used in these driving tools with a magazine containing a plurality of fastener slides. Each one of these slides can be loaded with fasteners of different size. The operator can position each slide to deliver its particular fastener to the driver. If, on the other hand, the operator chooses to load identically sized fasteners into each fastener slide, the storage capacity is greatly increased.

FIGS. 1–5 illustrate one embodiment of the magazine 8 of the present invention which includes fastener slides 10 that are arranged around a central core 12. A rod 14 is provided that slides into the central core 12. The central core 12 fits rotatably around the rod 14, thereby creating an axis of rotation for the magazine 8 about the rod 14. The rod 14 travels between the handle 4 and the driver 6. The rotation of the magazine 8 can be limited by stops (not shown) if only limited rotation is necessary to align all of the slides 10. For example, if only two slides are incorporated into a magazine, only a limited arc of rotation is required to properly position each slide.

When the magazine 8 is slid onto the rod 14, one end of the magazine and the slides 10 abut the driver 6. A feed means (not shown), for example, a spring-biased clip, in each slide 10 forces the fasteners toward the end of the slide abutting the driver 6. When a particular slide is positioned vertically against the driver 6, it becomes aligned with the driver 6. This alignment allows fasteners to travel from the slide into the driver 6 under the force exerted by the feed means. A position locking means maintains this alignment. In one embodiment, shown in FIG. 4, the position locking means takes the form of a pair of spring-loaded, ball bearing detents 18 provided in a side of the driver 6 abutting the magazine 8. These detents 18 are spaced from one another and positioned so that when a particular slide 10 is aligned with the driver 6, the slide 10 falls between the pair of detents 18. The detents 18 may be compressed to allow a slide 10 to pass when rotation of the magazine 8 is desired. However, when extended, the detents 18 prevent rotation of the magazine 8 and, therefore, maintain the slide's alignment with the driver 6.

During rotation of the magazine 8, the slides 10 will travel through a variety of orientations. Therefore, it is desirable to provide some means to contain the fasteners in the slides 10 at any angle of orientation while not interfering with the ability to load the fasteners or inhibiting their travel down the slide 10 and into the driver 6. One means for accomplishing this is the use of a magnetic strip down the length of each slide 10.

Another embodiment, illustrated in FIGS. 6–9, arranges the fastener slides 20 in a parallel relationship to one another in the magazine 22. This is the preferred embodiment of the invention. The magazine 22 itself can be shifted laterally to align each slide 20 with the driver 6. The magazine 22 is attached to the handle 4 and the base 2 of the fastener driving tool by a plurality of screws 24. The screws 24 fit through mounting slots 26 in the magazine 22 which permit a defined amount of lateral movement. A position locking means 28 is provided to accurately position the magazine 22 so that each one of the slides 20 can be aligned with the driver 6. A feed means, described below, forces the fasteners down the slide 20 and into the driver 6.

In the position locking means 28, a pin 32 is forced through one of a plurality of alignment holes (not shown) in the driver 6 of the fastener driving tool. Each alignment hole represents a position of the magazine 22 in which one of the fastener slides 20 is aligned with the driver 6. A spring 36 urges the pin 32 forward into each alignment hole. A bracket 38 holds the pin 32 in place against the magazine 20. To release the position locking means 28, the operator pulls back on the pin 32 against the force of the spring 36, removing the pin 32 from the current alignment hole. The magazine 22 may then be shifted to move a different fastener slide 20 into position. The operator then releases the pin 32, and the spring 36 urges the pin through the new alignment hole.

The feed means includes a feeder 40, a spring 42, and a spring cover 44. There is a separate feed means associated with each fastener slide 20. The feeder 40 acts directly on the fasteners loaded into the slide 20. The spring 42 places a constant force on the feeder 40 toward the driver 6. The operator can pull the feeder 40 back away from the driver 6 against the force of the spring 42 to load new fasteners into the slide 20. The spring cover 44 maintains the proper alignment of and prevents damage to the spring 42.

Other objects, features and advantages of the present invention will be apparent to those skilled in the art. While preferred embodiments of the present invention have been illustrated and described, this has been by way of illustration and the invention should not be limited except as required by the scope of the appended claims and their equivalents.

I claim:

1. A magazine for a nail gun having a powered driver and a base, comprising:

a plurality of nail slides, each nail slide being arranged parallel to one another and perpendicular to the powered driver, and each nail slide having a feed end and a load end, means for mounting the magazine for planar, lateral movement in a flat plane generally perpendicular to the powered driver between a plurality of feed positions wherein the feed end of each one of the nail slides is aligned with the powered driver, said means for mounting including a plurality of straight mounting slots in the magazine and a plurality of removable fasteners disposed in the mounting slots and connecting the magazine with the nail gun, said mounting slots being so constructed and arranged to permit a limited amount of only planar, lateral movement of the magazine perpendicular to the powered driver;

a feed means associated with each nail slide; and a position locking means that secures the magazine into each feed position.

2. A magazine for a nail gun as set forth in claim 1, further including a plurality of mounting slots in the magazine and wherein the magazine is attached to the nail gun by a plurality of removable fasteners which are disposed in the mounting slots, said mounting slots being so constructed and arranged to permit a defined amount of lateral movement of the magazine in the plane generally perpendicular to the powered driver.

3. A magazine for a nail gun asset forth in claim 1, wherein the position locking means includes:

a plurality of alignment holes located in the powered driver;

a pin connected with the magazine which is slid into any one of the alignment holes whereby the magazine is secured into a position in which the feed end of one of the nail slides is aligned with the powered driver; and a spring which urges the pin toward the powered driver.

4. A magazine for a nail gun as set forth in claim 1, wherein the feed means includes:

a feeder which acts on nails loaded into the nail slide;

a spring connected with the feeder which urges the feeder toward the powered driver; and a spring cover connected with the nail slide.

5. A magazine for a nail gun as set forth in claim 1, further including a nail securing means in each nail slide.

6. A magazine for a nail gun as set forth in claim 5, wherein the nail securing means is a magnetic strip arranged on one side of the nail slide.

7. A nail gun, comprising:

abase;

a powered driver connected with the base; and a magazine connected with the powered driver and the base which includes:

a plurality of nail slides, each nail slide being arranged parallel to one another and perpendicular to the powered driver, and each nail slide having a feed end and a load end;

means for mounting the magazine for planar, lateral movement in a flat plane perpendicular to the powered driver between a plurality of feed positions wherein the feed end of each one of the nail slides is aligned with the powered driver, said means for mounting including a plurality of straight mounting slots in the magazine and a plurality of removable fasteners disposed in the mounting slots and connecting the magazine with the nail gun, said mounting slots being so constructed and arranged to permit a limited amount of only planar, lateral movement of the magazine perpendicular to the powered driver;

a feed means associated with each nail slide; and a position locking means that secures the magazine into each feed position.

8. A nail gun as set forth in claim 7, further including a plurality of mounting slots in the magazine and wherein the magazine is attached to the nail gun by a plurality of removable fasteners which are disposed in the mounting slots, said mounting slots being so constructed and arranged to permit a defined amount of lateral movement of the magazine in the plane generally perpendicular to the powered driver.

9. A nail gun as set forth in claim 7, wherein the position locking means includes:

a plurality of alignment holes located in the powered driver;

a pin connected with the magazine which is slid into any one of the alignment holes whereby the magazine is secured into a position in which the feed end of one of the nail slides is aligned with the powered driver; and a spring which urges the pin toward the powered driver.

10. A nail gun as set forth in claim 7, wherein the feed means includes:

a feeder which acts on nails loaded into the nail slide;

a spring connected with the feeder which urges the feeder toward the powered driver; and a spring cover.

11. A nail gun as set forth in claim 10, further including a nail securing means in each nail slide.

12. A nail gun as set forth in claim 11, wherein the nail securing means is a magnetic strip arranged on one side of the nail slide.

* * * * *

UNITED STATES PATENT AND TRADEMARK OFFICE

CERTIFICATE OF CORRECTION

PATENT NO. : 6,641,019 B2
DATED : November 4, 2003
INVENTOR(S) : Robert Hadfield It is certified that error appears in the above-identified patent and that said Letters Patent is hereby corrected as shown below:

Column 6,
Lines 31 and 32, should read as follows: -- A nail gun as set forth in claim 7, further including a nail securing means in each nail slide. --

Signed and Sealed this

Sixteenth Day of March, 2004

JON W. DUDAS
*Acting Director of the United States Patent and Trademark Office*